US007701354B2

(12) United States Patent
Chung

(10) Patent No.: US 7,701,354 B2
(45) Date of Patent: Apr. 20, 2010

(54) PORTABLE ALARM TRANSMITTER FOR COMPLIANCE MONITORING

(75) Inventor: Andrew Chung, Hong Kong (CN)

(73) Assignee: Standard Telecommunications Ltd., Hong Kong (CN)

( * ) Notice: Subject to any disclaimer, the term of this patent is extended or adjusted under 35 U.S.C. 154(b) by 359 days.

(21) Appl. No.: 11/769,726

(22) Filed: Jun. 28, 2007

(65) Prior Publication Data

US 2009/0002152 A1 Jan. 1, 2009

(51) Int. Cl.
*G08B 23/00* (2006.01)

(52) U.S. Cl. ..... 340/573.7; 340/573.1; 340/575; 340/539.11; 340/539.12

(58) Field of Classification Search ..... 340/573.1, 340/573.7, 575, 539.12, 539.14, 309.16, 340/309.4, 309.8, 539.11
See application file for complete search history.

(56) References Cited

U.S. PATENT DOCUMENTS 6,819,247 B2 * 11/2004 Birnbach et al. ..... 340/573.1
7,277,018 B2 * 10/2007 Reyes et al. ..... 340/573.1
2003/0025604 A1 * 2/2003 Freeman ..... 340/573.1
2006/0270949 A1 * 11/2006 Mathie et al. ..... 600/595
2007/0146145 A1 * 6/2007 Lehrman et al. ..... 340/573.1

* cited by examiner

*Primary Examiner*—George A Bugg
*Assistant Examiner*—Hongmin Fan
(74) *Attorney, Agent, or Firm*—Eagle IP Limited; Jacqueline C. Lui; Ho Chung Lui

(57) ABSTRACT

A portable alarm transmitter for compliance monitoring detects whether a user is wearing the device. If not, a special alarm signal is sent to the monitoring service provider so that remedial actions can be taken. The alarm transmitter comprises a motion sensor, and an algorithm thereby for detecting whether the alarm device is being worn by the user. The alarm transmitter distinguish between non-compliance (e.g. user has taken off the alarm device) versus other "activities of daily living (ADL) that may appear to be non-compliance events (e.g. sleeping) by incorporating user stimulus and user response.

19 Claims, 3 Drawing Sheets

PORTABLE ALARM TRANSMITTER FOR COMPLIANCE MONITORING

FIELD OF INVENTION

This invention relates to an alarm device, and in particular a portable alarm transmitter for monitoring compliance of a user.

BACKGROUND OF INVENTION

Many applications, such as but not limited to the monitoring of the elderly, call for the use of a wireless alarm transmitter that could be worn on a user to allow the user to call for assistance. In some cases, an organization provides a service to allow users to call for help in case, for example, if the user has fallen. However, nothing can be done if the user is not wearing the alarm device or has it placed near him/her when the need arises to call help.

SUMMARY OF INVENTION

In the light of the foregoing background, it is an object of the present invention to provide an alternate device and system to facilitate the call for assistance for those in need.

In accordance with the object of the present invention, there is provided an alarm transmitting device that is able to monitor user compliance. A sensor may be used to detect the activity e.g. motion of the user, and send out an alarm if no activity is detected within a pre-determined period of time. Additional elements are also provided to differentiate user's non-compliance (i.e. the user is not wearing the wireless alarm transmitter so it remains motionless) versus the actual motionless state of the user. Preferably, the device should also make a distinction between normal activities of daily living (ADL) where the user is relatively motionless (e.g. sleeping) against actual motionless state (e.g. the user faints away or being unconscious).

Accordingly, the present invention, in one aspect, is a portable alarm triggering device, including:

a) a sensor configured to sense any abnormal status of a user;
b) a stimuli generating means capable of transmitting a stimuli to the user;
c) a user input means configured to receive an explicit input from the user;
d) a transmitter configured to transmit an alarm signal to a third party;
e) a control unit coupled to the sensor, the stimuli generating means and the user input means. When the sensor detects the abnormal status of the user, the control unit causes the stimuli generating means to stimulate the user and subsequently generates the alarm signal to a third party through the transmitter, unless the control unit receives the explicit input as a cut-off signal from the user within a predefined period.

Using the above configuration, the portable alarm triggering device is capable of monitoring the user and can automatically call for assistance when the abnormal status of the user is detected.

In a preferred embodiment of the present invention, the control unit is capable of generating the alarm upon solely receiving an explicit input at the user input means from the user in the absence of the stimuli. This provides the additional benefit of the device acting as a simple alarm.

In another preferred embodiment, the third party includes a receiving station, a service center and a communication network therebetween. The receiving station is able to forward the alarm signal from the transmitter of the portable alarm triggering device to the service center via the communication network.

According to another aspect of the present invention, a method for automatically calling for assistance by a portable alarm triggering device is provided. This method is able to perform the steps of:

a) sensing the abnormal status of the user by a sensor;
b) stimulating the user by a stimuli generating means when the abnormal status of the user is detected;
c) listening for a response from the user in a predefined period after stimulating the user; and
d) generating an alarm signal to a third party if the response is not received within the predefined period.

There are many advantages to the present invention. One of the advantages is the capability to distinguish between user's abnormal status and other normal ADL activities. The precondition of transmitting a stimulus to the user and monitoring the user response thereafter ensures that when the alarm is triggered, the user will not be in the ADL status, since the user response would deactivate the triggering of the alarm. Another advantage is that if the alarm is triggered, it is either because (1) the user's health is in such a serious state that he is not capable of sending the explicit input to the device, or (2) the user is in the non-compliance state (e.g. not wearing the device). In both of these abnormal statuses, the alarm may be sent to a service provider. The service provider can contact the user through a separate communication channel to verify which of aforementioned abnormal conditions the user is in, and contact other health care providers accordingly. Therefore, the reliability of alarm monitoring service is greatly increased, which benefits both to the user (additional safety) and to the service provider (less false alarms and liability).

DETAILED DESCRIPTION OF THE PREFERRED EMBODIMENTS

As used herein and in the claims, "comprising" means including the following elements but not excluding others.

As used herein and in the claims, "couple" or "connect" refers to electrical coupling or connection either directly or indirectly via one or more electrical means unless otherwise stated.

Figure 1:
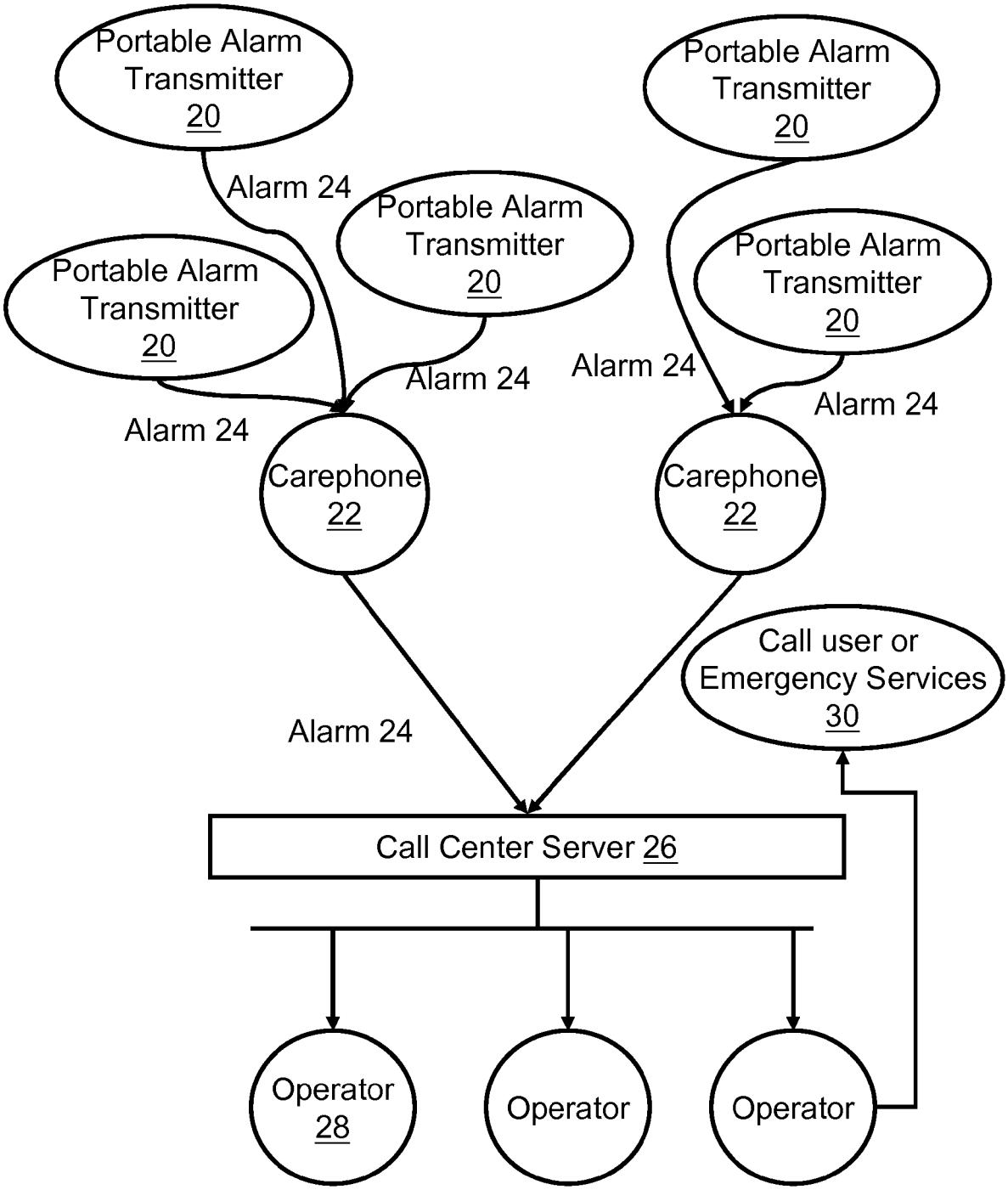
FIG. 1 is a block diagram of the emergency alarm system in one embodiment of the present invention.

Referring first to FIG. 1, the first embodiment of the present invention is a compliance monitoring system, which consists of a plurality of portable alarm transmitters 20 to be worn by users, one or more carephones 22 in the user's premises, and a call center server 26 which may be located remotely to the carephones 22. Within the call center server 26, there are also one or more operators 28 who can further make calls to other parties consequently.

Figure 2:
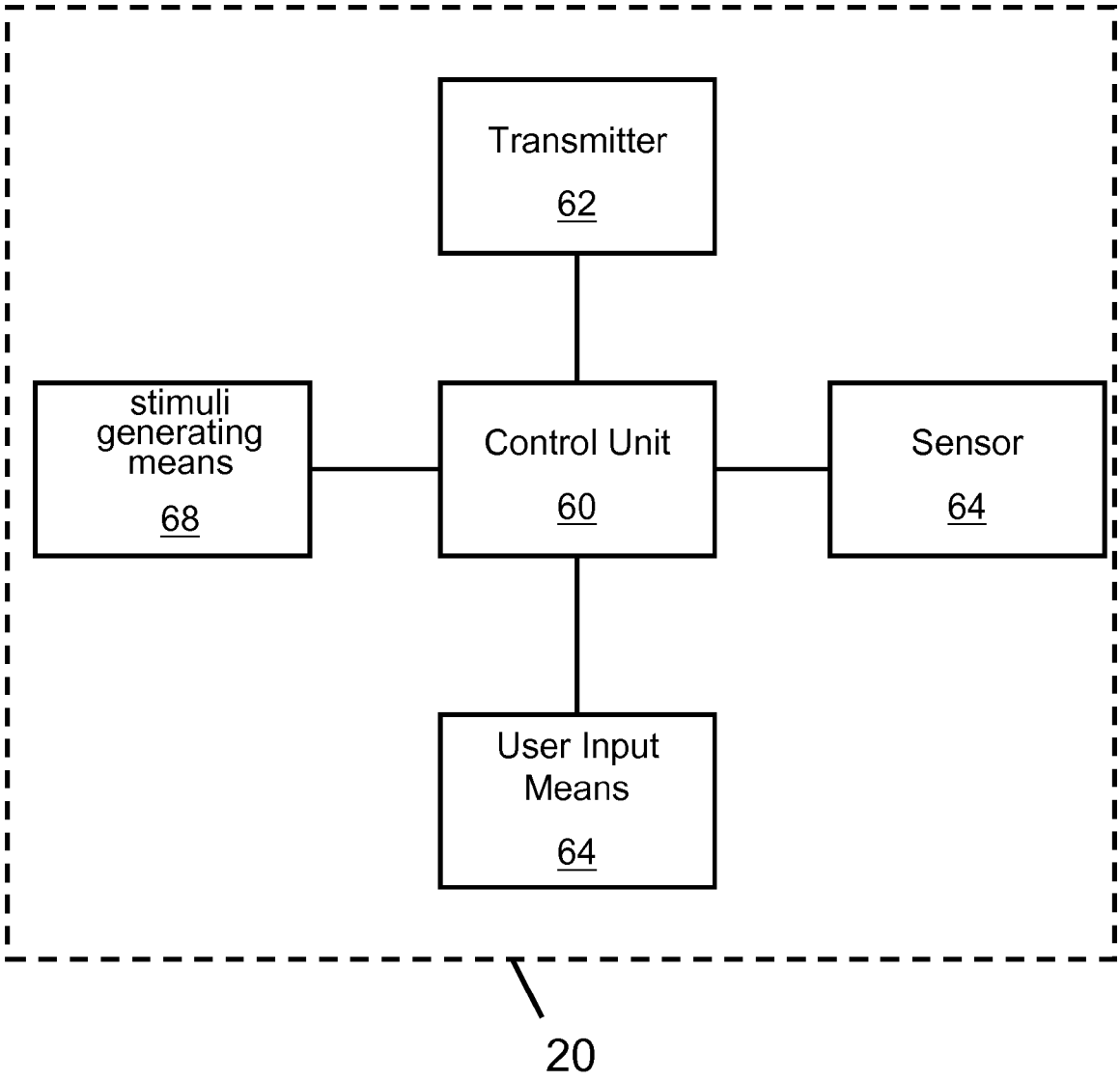
FIG. 2 is the internal block diagram of the portable alarm transmitter of the same embodiment of the present invention.

Referring now to FIG. 2, an example of a portable alarm transmitter 20 contains a control unit 60, a stimuli generating means 68, a transmitter 62, a sensor 64 and a user input means 66. These parts are connected to each other within the control unit 60. In a more preferred embodiment, the control unit 60 is a microprocessor or microcontroller. The stimuli generating means 68 maybe a light-emitting diode (LED), buzzer or vibrator. The sensor 64 is a movement detector such as an accelerometer. The transmitter 62 is a Radio Frequency (RF) wireless transmitter. The user input means 66 may be a button.

Figure 3:
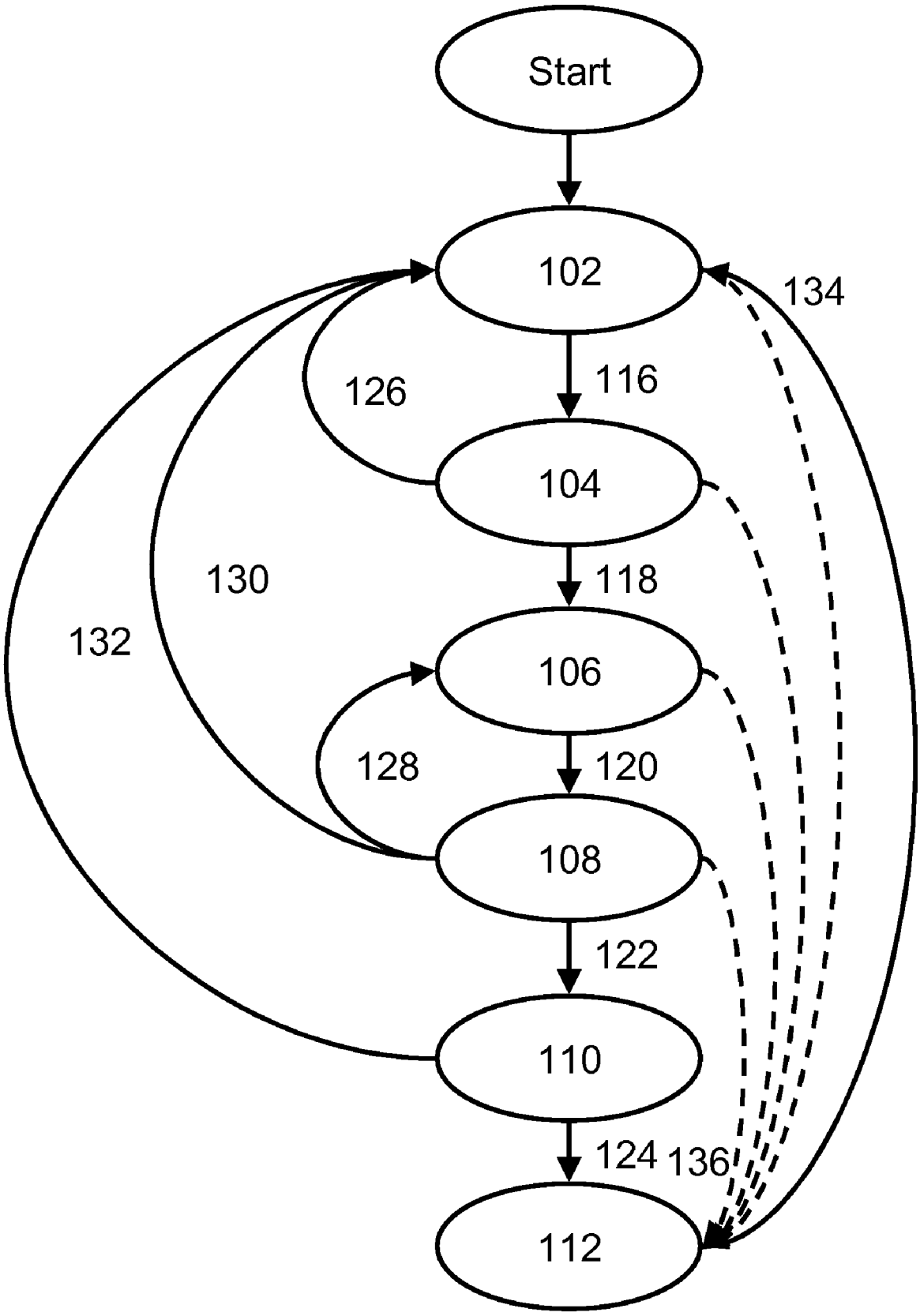
FIG. 3 is a flow chart showing the working principle of the portable alarm transmitter according to the principles of the present invention.

Now turning to the operation of the device described above, FIG. 3 in combination with FIG. 2 show how the portable alarm transmitter (hereinafter 'device') according to the present invention may be used to monitor the user's abnormal status and sending out the alarm signal accordingly. During operation, the device starts in state 102, where it starts a timer TMR1. When TMR1 expires, the device takes transition 116 to state 104. In state 104, the device will activate sensor 64 to check for the activity or movement of the user. If activity is detected, the device takes transition 126 back to state 102 and restarts TMR1. If no activity is detected, the device transmits to state 106 and timers TMR2 and TMR3 (TMR3 has a longer timeout than TMR2) are started. When TMR2 expires, the device takes transition 120 to state 108. In state 108, the device checks the sensor 64 again for activity. If activity is detected, the device transmits via 130 back to state 102 and restarts TMR1. If no activity is detected and TMR3 has not expired, the device transmits via 128 back to state 106 and restarts timer TMR2. Otherwise, if no activity is detected and TMR3 has expired, the device takes transition 122 to state 110, triggers the stimulus generating means 68 to generate a stimulus, starts timer TMR4, and waits for a response from the user. If a response is detected from the user input means 66, the device transmits via 132 back to state 102 and restarts TMR1. If the timer TMR4 expires but no response is detected, then the device goes to state 112 and an alarm condition is triggered, and the device transmits via 134 back to the initial state 102 and restarts TMR1. In summary, whenever a user activity or movement is sensed during the states 102 to 108, the device will return to its original state and no alarm will be triggered. Even when the device enters state 110, if the user in ADL can give a response in the predefined period, the device would still return to its original state 102 rather than triggering the alarm, and this can ensure that the device will not wrongly send out an alarm when the user is in ADL.

In a specific implementation of the aforementioned embodiment, the control unit 60 is a conventional microcontroller, for example, Freescale MC9RS08KA2. The sensor 64 is an accelerometer, model MMA7260Q from Freescale Semiconductor. The stimulus generating means 68 is a LED, and the user input means 66 is a button. In another implementation, the user input means 66 is the act of changing position of the portable alarm triggering device by the user. Moreover, the values of the various timers are adjustable for different user profiles. For example, when at night the user is sleeping, the pre-defined period before the device transmits the stimuli or alarm could be relatively longer, while that could be shorter in the daytime when the user is doing some normal ADL. Accordingly, the device could have multiple operating modes, for example, one especially for use in sleeping hours and another one for working hours. In a more preferred embodiment, the device has the capability of automatically switching between different operating modes, depending on the clock time. For example, in the evening the device could be automatically switched off during the sleeping hours to avoid unnecessary alarms. Some typical settings for various timers mentioned above, in different modes, are shown as follows:

| Timer | Duration in Seconds (day time) | Duration in Seconds (night time) |
|---|---|---|
| TMR1 | 1200 | 3600 |
| TMR2 | 60 | 3600 |
| TMR3 | 1200 | 28800 |
| TMR4 | 60 | 60 |

In a preferred embodiment, the device is also capable of directly triggering an alarm if the user explicitly intends to do so. This is demonstrated also in FIG. 2 and FIG. 3, where in any one of the states 102, 104, 106 and 108, the device can make transition 136 to the state 112 directly upon receiving an explicit user input from button 66, and also triggers the alarm condition. In this way, the portable alarm transmitter 20 also plays the role of an ordinary emergency alarm system to let the user call for emergency assistance when they have the needs.

Next, when the alarm condition of the portable alarm transmitter 20 is triggered, it will send out an alarm 24 via the transmitter 62 to the carephone 22 as shown in FIG. 1. In a preferred embodiment, the carephone 22 is located near the portable alarm transmitter 20 in order to receive the short-distance alarm signal transmitted from the alarm transmitter 20. As an example, the carphone 22 resides in the living quarter of the user who wears the portable alarm transmitter 20. The carephone 22 then relays the alarm 24 to a remote call service center 26. In a particular embodiment, the call service center 26 could be located in the same city as of the user's house, and the carephone 22 connects to the call service center 26 through the means of a communication network. In a more preferred embodiment, the communication network is a fixed-line telephone network.

Once the call service center 26 receives the alarm 24 from one or more users, the operators 28 in the call service center as shown in step 30 may call back the user whose portable alarm transmitter sent out the alarm signal to understand what kinds of abnormal status is generated. If the abnormal status is due to non-compliance (i.e. the user does not wear the wireless alarm transmitter 20, then the operator 28 can remind him or her to do so. If the abnormal status is that the user is unconscious or not able to move, then the operator 28 can quickly alert the appropriate health care provider to provide emergency help to the user.

Furthermore, the control unit 60 shown in FIG. 2 is also capable of recording the proportion of 1) the time duration that the user is wearing the portable alarm transmitter (In one embodiment, it records the time duration when the user starts to put on the portable alarm transmitter until the time when he takes off the portable alarm transmitter.), versus 2) the time duration starting from when the portable alarm transmitter starts 102 till it triggers said stimulus 110. During the time duration from state 102 to 110, there may also be one or more returning 126 and 130 through which the device is back to the initial state 102. The recording of time durations may be done by utilizing a plurality of timers in the control unit 60. Such recordings may be transmitted to a third party thereafter for investigation of alarm system users' behaviors.

The preferred embodiments of the present invention are thus fully described. Although the description referred to particular embodiments, it will be clear to one skilled in the art that the present invention may be practiced with variation of these specific details. Hence this invention should not be construed as limited to the embodiments set forth herein.

For example, the sensor in the described embodiment is a motion sensor, or an accelerometer in a more preferred embodiment. But it will be clear to one skilled in the art that other kinds of sensors beside motion sensors, which can sense the various status of human body, can be used for the same purpose. This includes but not limited to electroencephalograph sensors, electrooculograph sensors, infra-red sensors, body temperature sensor, . . . , etc.

Moreover, the described communication network between the carephone 24 and call service center 26, as shown in FIG. 1, is preferable a telephone network, as it is the most common and reliable communication network in a city. However people of ordinary skill in the art will naturally consider using other kinds of advanced communication networks such as wireless communication network, Cable-TV network, Internet network, Metropolis Area Network (MAN), Wi-Max network, etc.

While FIG. 1 depicts one example of how an alarm 24 can be transmitted from the portable alarm transmitter 20 to the call center server 26 via the carephone 22, it should not be construed as the only way to send the alarm signal. Those skilled in the art can design different communication architecture to send the alarm signal reliably to the call center server.

What is claimed is:

1. A portable alarm triggering device comprising:

a) a sensor configured to sense any abnormal status of a user;

b) a stimuli generating means capable of transmitting a stimuli to said user;

c) a user input means configured to receive an explicit input from said user;

d) a transmitter configured to transmit an alarm signal to a third party;

e) a control unit coupled to said sensor, said stimuli generating means and said user input means, said control unit further comprising a plurality of different timers, each said timer being set with a predetermined time setting; when said sensor detects said abnormal status of said user after all of said plurality of timers have expired, said control unit causes:

i) said stimuli generating means to stimulate said user; and subsequently ii) said transmitter to generate said alarm signal to said third party through said transmitter unless said control unit receives said explicit input as a cut-off signal from said user within a predefined period;

whereby said portable alarm triggering device monitors said user and can automatically call for assistance when said abnormal status of said user is detected.

2. The portable alarm triggering device of claim 1, wherein said control unit being capable of generating said alarm upon solely receiving said explicit input at said user input means from said user in the absence of said stimuli.

3. The portable alarm triggering device of claim 2, wherein said third party comprising a receiving station, a service center and a communication network therebetween; said receiving station being able to forward said alarm signal from said transmitter of said portable alarm triggering device to said service center via said communication network.

4. The portable alarm triggering device of claim 3, wherein said communication network is a telephone network.

5. The portable alarm triggering device of claim 3, wherein said communication network is a wireless communication network.

6. The portable alarm triggering device of claim 2, wherein said user input means in a button that can be pressed by said user.

7. The portable alarm triggering device of claim 2, wherein said user input means is the act of changing position of said portable alarm triggering device by said user.

8. The portable alarm triggering device of claim 2, wherein said stimuli generating means can be selected from an audio stimulus, visual stimulus, vibrating device, or any combination thereof.

9. The portable alarm triggering device of claim 2, wherein said sensor is a movement detector.

10. The portable alarm triggering device of claim 9, wherein said movement detector is an accelerometer.

11. The portable alarm triggering device of claim 9 further comprises a first timer, a second timer and a third timer; said first timer starting when said portable alarm triggering device starts; said movement detector being activated after said first timer is expired; said second timer starting after said first timer is expired; said control unit causing said stimuli generating means to stimulate said user and starting said third timer if said abnormal status arises after said second timer is expired and said movement detector has not detected any movement from said user; said alarm signal being transmitted to said third party through said transmitter unless said control unit receives said explicit input as a cut-off signal from said user within said predefined period before said third timer expires.

12. The portable alarm triggering device of claim 1, wherein said control unit recording the proportion of the time duration when said user is wearing said portable alarm triggering device versus the time duration starting from said portable alarm triggering device starts until said portable alarm triggering device triggers said stimulus; said record being transmitted to said third party thereafter.

13. The portable alarm triggering device of claim 1, wherein said control unit automatically switch off said portable alarm triggering device during a pre-determined period of the date to avoid generating unnecessary alarms to said third party.

14. A method for automatically calling for assistance by a portable alarm triggering device, comprising the steps of:

a) sensing the abnormal status of said user by a sensor;

b) stimulating said user by a stimuli generating means when said abnormal status of said user is detected after a plurality of different timers in said portable alarm triggering device have expired, each said timer being set with a predetermined time setting; and c) generating an alarm signal to a third party if a response is not received from said user within a predefined period.

15. The method of claim 14, wherein said third party is a service centre and said generating step further comprises the step of transmitting said alarm signal to said service centre.

16. The method of claim 14 further comprises the step of contacting said user through a second communication channel by an operator from said service center to determine said user's abnormal status after receiving said alarm signal from said transmitting step.

17. In a portable alarm triggering device having a sensor configured to sense any abnormal status of a user, a stimuli generating means capable of transmitting a stimuli to said user, a user input means configured to receive an explicit user input from said user, a transmitter configured to transmit and alarm signal to a third party, and a control unit coupled to said sensor, said stimuli generating means and said user input means, the improvement comprising:

a) means for causing said stimuli generating means to stimulate said user when said sensor detects said abnormal status of said user after a plurality of different timers with predetermined time settings in said control unit have expired;

b) means for subsequently generating said alarm signal to said third party through said transmitter unless said control unit receives said explicit input as a cut-off signal from said user within a predefined period.

18. The portable alarm triggering device of claim 1, wherein said control unit automatically switch between different operating modes, depending on clock time.

19. The method of claim 14, wherein said portable alarm triggering device further comprises a first timer, a second timer and a third timer; said stimulating step further comprises the following steps:

i) starting said first timer when said portable alarm triggering device starts;

ii) activating said sensor and starting said second timer after said first timer is expired;

iii) stimulating said user and starting said third timer if said abnormal status arises, wherein said second timer is expired and said sensor has not detected any movement from said user; and said generating step further comprising the step of transmitting said alarm signal to said third party unless said response from said user is received within said predefined period before said third timer expires.

* * * * *